US007486173B2

(12) United States Patent
Fisler

(10) Patent No.: US 7,486,173 B2
(45) Date of Patent: Feb. 3, 2009

(54) SYSTEM AND METHOD FOR SETTING PARAMETERS FROM CONTROL PANEL

(75) Inventor: Charles F. Fisler, Sycamore, IL (US)

(73) Assignee: Honeywell International Inc., Morristown, NJ (US)

( * ) Notice: Subject to any disclaimer, the term of this patent is extended or adjusted under 35 U.S.C. 154(b) by 279 days.

(21) Appl. No.: 10/999,876

(22) Filed: Nov. 30, 2004

(65) Prior Publication Data

US 2006/0125650 A1 Jun. 15, 2006

(51) Int. Cl.
*G08B 3/10* (2006.01)

(52) U.S. Cl. ..... 340/384.73; 340/628; 340/632; 340/506; 340/521; 340/539.19; 340/691.1; 340/692

(58) Field of Classification Search ..... 340/628, 340/630, 632, 506, 521, 531, 539.1, 539.19, 340/539.27, 577, 584, 384.73, 825.36, 825.49, 340/691.1, 692
See application file for complete search history.

(56) References Cited

U.S. PATENT DOCUMENTS 4,737,770 A 4/1988 Brunius et al.
4,772,876 A 9/1988 Laud
5,565,852 A * 10/1996 Peltier et al. ..... 340/632
5,594,417 A 1/1997 Morita
5,650,800 A 7/1997 Benson
6,198,389 B1 3/2001 Buccola
6,344,799 B1 * 2/2002 Walker ..... 340/691.1
6,529,128 B2 * 3/2003 Weng ..... 340/539.1
6,624,750 B1 9/2003 Marman et al.
6,693,529 B2 2/2004 Suzuki et al.
7,005,999 B2 * 2/2006 Salzhauer et al. ..... 340/686.1
2002/0070869 A1 6/2002 Dungan

* cited by examiner

*Primary Examiner*—Hung T. Nguyen
(74) *Attorney, Agent, or Firm*—Husch Blackwell Sanders Welsh & Katz

(57) ABSTRACT

Parameters defining operational characteristics of audible, visual or audible/visual alarm indicating output devices, can be transmitted to the respective devices from common output control circuitry to avoid having to set up the devices electromechanically in the field upon installation, or upon replacement for maintenance purposes. The downloaded parameters can be stored locally at the respective device and can include prerecorded verbal messages, horn or chime output volumes, tonal patterns and repetition rates. Candela settings for strobes can also be downloaded from the control circuitry.

11 Claims, 2 Drawing Sheets

SYSTEM AND METHOD FOR SETTING PARAMETERS FROM CONTROL PANEL

FIELD OF THE INVENTION

The invention pertains to fire monitoring systems and output devices therefore. More particularly, the invention pertains to audible, visual or audible/visual output devices which incorporate circuitry by which parameters therefore can be downloaded from a remote source.

BACKGROUND OF THE INVENTION

It has been known to incorporate audible and visual output alarm indicating devices in connection with various types of fire monitoring systems. Such systems, which are usually installed to monitor conditions in a region of interest, often include a plurality of audible and visible output devices scattered throughout the region being monitored. Such devices usually receive electrical energy from the monitoring system. Optionally, they can be energized via a local power supply.

In some known systems the audible and visual output devices incorporate switches, jumpers and the like for purposes of setting device parameters. For example, representative parameters include output volume and/or tone pattern for horns, output volume and/or repetition rate and tonal characteristics for chimes, input power and amplifier voltages for speakers. For visual devices, such as strobes, light intensity or candela setting is required. Very often establishing such settings requires that the installers read blueprints or wiring diagrams. All of these steps are error prone and also slow down the installation process.

FIG. 1 illustrates an exemplary prior art alarm and monitoring system 10 which can be installed in and usable to monitor a region R. The system 10 includes a plurality of spaced apart detectors 14. The detectors 14 could include fire detectors, smoke detectors, gas detectors and the like, all without limitation. The detectors are in communication via a medium 16, which could be wired or wireless, with a common monitoring control system 20. System 20 which could incorporate one or more programmed processors communicates with the members of the plurality 14.

System 20 also incorporates audible, visible output control circuitry 22. The circuitry 22 can be used to provide electrical energy to a notification appliance circuit indicated generally at 26. The circuit 26 has coupled thereto a plurality of audible, visible devices indicated generally at 28. The devices 28 could include audible only, visual only or combined audible/visual devices.

The devices on the notification appliance circuit 26 are energized by the output control circuitry 22 in response to the monitoring system 20 determining that an alarm condition, perhaps a fire or gas condition is present somewhere in the region R. When the notification appliance circuit 26 has been energized, all of the devices 28 receive power from the control circuits 22 and enter an active state emitting their respective audible or visual alarm indicating outputs in accordance with their respective previously established switch settings.

FIG. 2 illustrates a representative member 28*i* of the plurality of output devices 28. As noted above, the device 28*i* receives electrical energy via the notification appliance circuitry 26. The device 28*i* incorporates both audible and visual outputs. In this embodiment, an installer would set one or more switches 30*a* to establish the audio outputs and one or more switches 30*b* to establish the visual intensity outputs.

Switches 30*a*, 30*b* are in turn coupled to control circuitry 34 which could be implemented, at least in part, with a programmed processor and executable instructions 34*a*. The executable instructions 34*a* can provide functionality to 34*b,c* to read the audio select switch(s), 30*a* as well as the candela select switch(s) 30*b*.

The executable instructions 34*a* can additionally generate one or more audio output waveforms, in combination with appropriate output hardware as would be understood by those of skill in the art. Output signals from the audio waveform generator 34*d* can be in turn coupled to audio drive circuitry 38*a* which can in turn drive the physical audio output device 38*b*.

Strobe control instructions 34*e*, in combination with any needed processor hardware, as would be understood by those of skill in the art, can couple strobe control signals to strobe circuit 40*a*. The circuit 40*a* in response to signals received from the hardware/software combination 34, 34*e* can in turn drive strobe light 40*b*.

The switches 30*a*, 30*b* are, as noted above, set when the respective device 28*i* is being installed. They are hidden from view when the device is mounted on a base or on a electrical box. To change the settings the respective device must be removed from its installed location, usually on a wall or on a ceiling. The switches are readjusted and then the device 28*i* can be reinstalled.

In view of the above, it would be desirable to be able to minimize the actions the installer would have to take to install the respective device, such as the device 28*i*. It would also be desirable to be able to take advantage of economies of scale and to the greatest extent possible, install common audible, visual or combined audible/visual output devices throughout a region irrespective of whether the devices are to produce horn or chime type outputs or verbal inputs, or, visual indicia, light. Further, it would be desirable to replace existing audible, visual or audible/visual units with another unit in the field without having to determine what the prior switch settings had been so as to replicate them in the replacement unit.

DETAILED DESCRIPTION OF THE EMBODIMENTS

Figure 1:
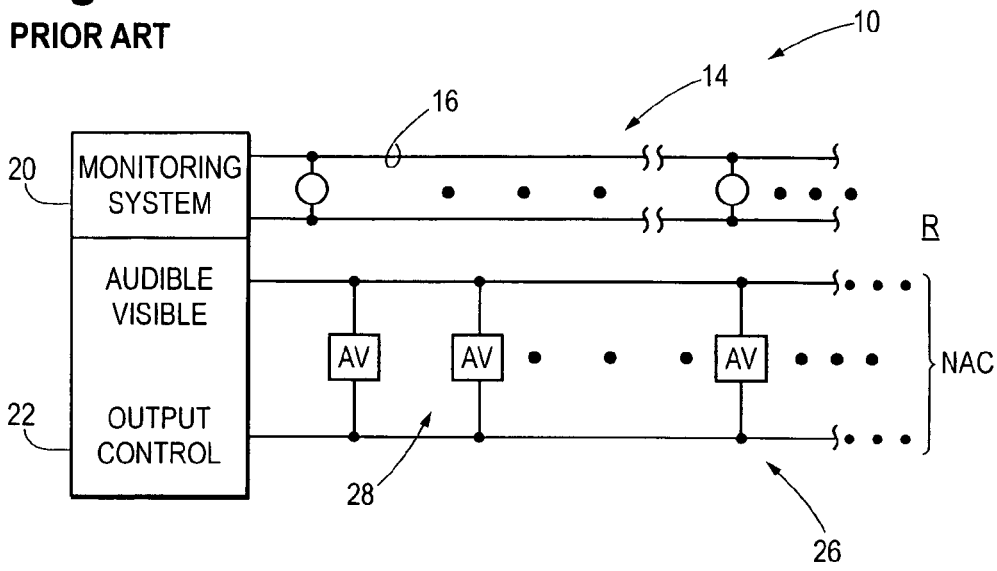
Fig. 1 PRIOR ART
FIG. 1 is a block diagram of an exemplary prior art regional monitoring system.
Figure 2:
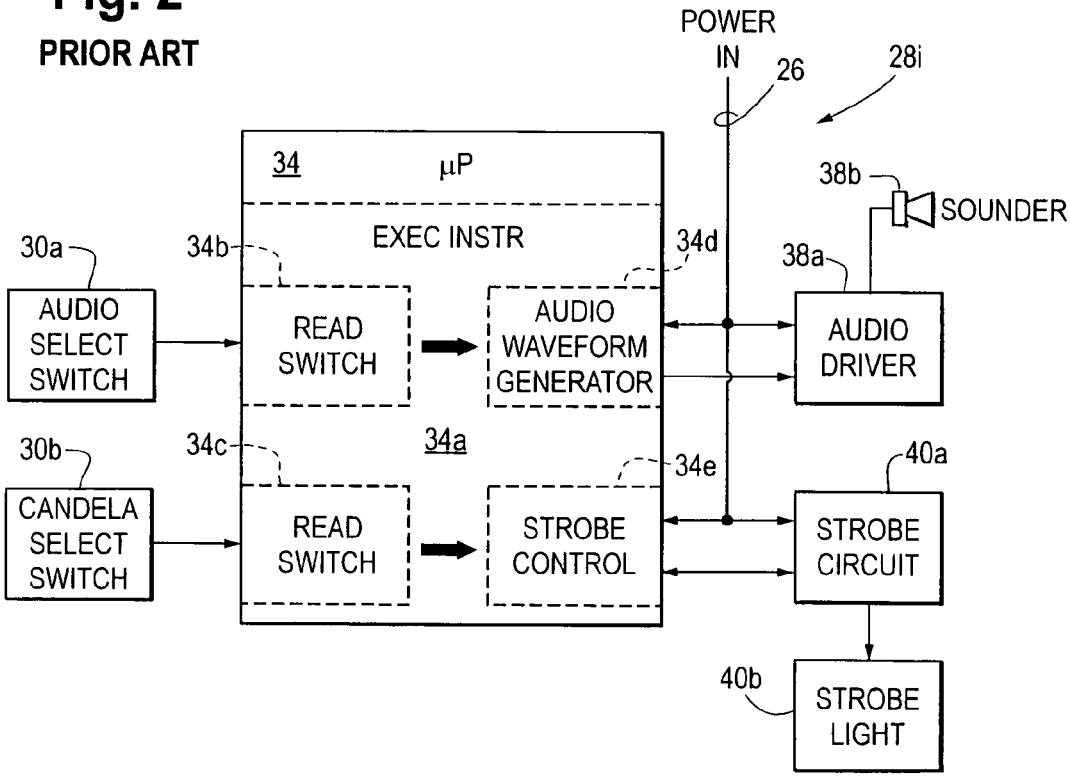
Fig. 2 PRIOR ART
FIG. 2 is a block diagram of an exemplary prior art audible/visual output device.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

Systems and methods in accordance with the invention simplify the procedure for installing audible, visual and audible/visual devices. The same type of product could potentially be installed in every location throughout the region R being monitored where required.

Systems and methods in accordance with the invention relieve the installers from having to read the blueprints and/or wiring diagrams as well as having to spend time figuring out settings for the audible/visual devices. They minimize installer errors in setting output device characteristics. Further, changes in settings can be effected without having to have an installer go into the respective region and remove the device from its installed location for purposes of adjusting the parameter settings thereon.

The systems and methods in accordance with the invention provide enhanced flexibility in that output device settings can be changed virtually instantaneously from the monitoring system control panel to fit changing circumstances. For example, it at times might be desirable to alter the output light intensity from a strobe unit, change the output volume of chimes or horns or tone pattern and/or repetition rates therefore in view of redecorating, altering walls and spaces within the region being monitored or other regional changes. Systems and methods which embody the invention make it possible to respond quickly and efficiently to such changes.

Finally, in accordance with the invention, the audible, visible products can be simplified by eliminating switches on the respective product for the purpose of setting parameters. Products can then be made less expensive and smaller.

In accordance with the invention, audible, visible or audible/visible output device parameter settings can be established at respective devices by downloading same from the monitoring system control panel to the respective device or devices. Settable parameters include a light intensity setting, a candela setting, for strobes. The output volume, tonal patterns such as temporal or continuous can be remotely set for horns. The output volume, repetition rate and tone characteristics can be remotely set for chimes. Devices which incorporate both audible and visual devices can have both sets of parameters set, after installation, from the monitoring system control panel.

Where the region also includes a displaced plurality of speakers for purposes of providing audible output messages, such messages can be downloaded in a digital format from the monitoring system and then reconstituted at the appropriate speaker module(s) for output.

Figure 3:
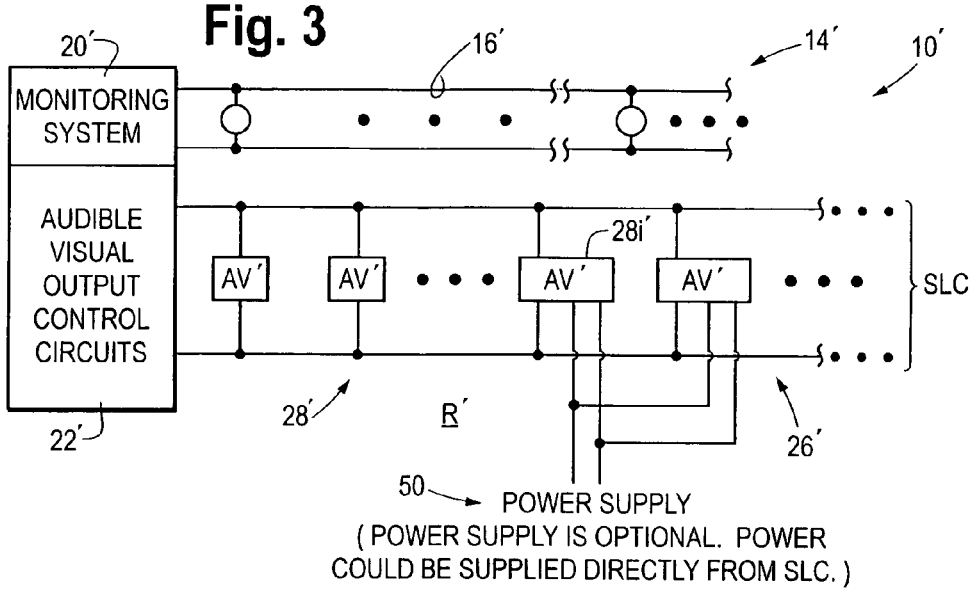
FIG. 3 is a block diagram of a monitoring system in accordance with the present invention.

FIG. 3 is a block diagram of a system 10' in accordance with the invention. The system 10' incorporates a plurality 14' of fire, smoke, gas detectors or the like, which are in communication via a medium 16', which could be wired or wireless with a regional monitoring system 20'.

The regional monitoring system 20' incorporates audible/visual output control circuits 22', discussed in more detail subsequently. Circuits 22' are coupled by a signaling loop circuit 26' to a plurality 28' of audible, visual or audible/visual output devices. The output control circuits 22' can individually address each of the members of the plurality 28', for example, the device **28*i*'**.

In alternate types of systems, individual addresses need not be used. Some or all devices in this alternate would be addressable simultaneously.

It will be understood by those of skill in the art that the plurality of the devices 28' could be powered directly off of the signaling loop circuit 26'. Alternately, respective of the devices such as **28*i*', could be provided with a local, optional, power supply indicated generally at 50**.

As discussed in more detail subsequently, the output control circuits 22' can couple address signals as well as parameter signals, via signaling loop circuit 26' to one or more of the output devices, such as the device **28*i*'. The output control circuits 22'** can turn any of the devices on or off, as well as download data and/or parameters to the respective device(s).

The downloaded data can include parametric information as to all settings which are required to define device operation. Alternately, messages to be audibly output can be downloaded. In addition to downloading parametric information via the circuit 26', the output control circuits 22' can also download replacement or updated control programs to the respective output devices, such as the device **28*i*'**.

Figure 4:
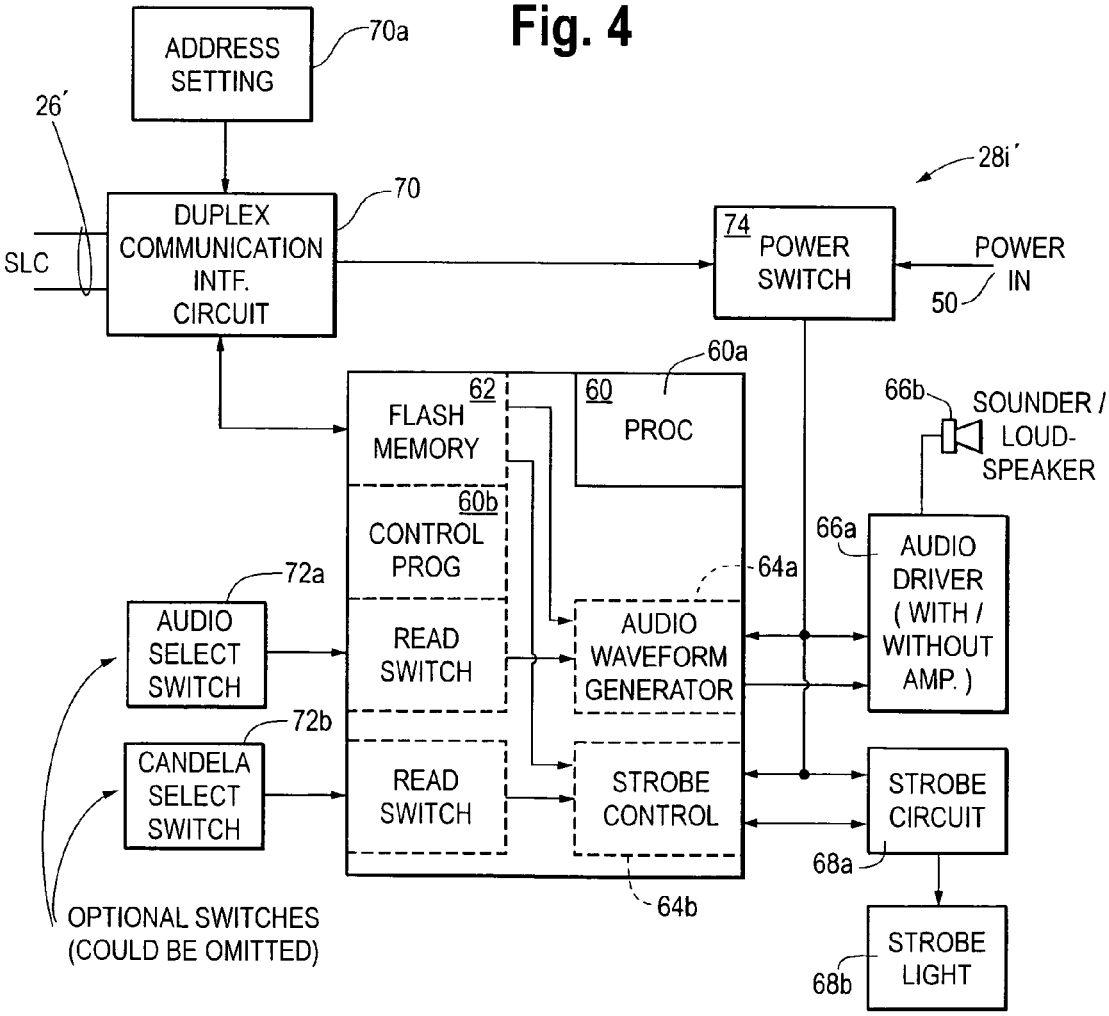
FIG. 4 is a block diagram of an audible/visual output device in accordance with the invention.

FIG. 4 is a block diagram of an output device **28*i*' which could correspond to an audible output device, such as a horn or chimes, or alternately, a loud speaker. Device 28*i*'** could correspond to a visual output device such as a strobe light or, a combination of audible/visual output device.

The device **28*i*' includes control circuitry 60 which could be implemented with a programmable processor 60*a* and associated executable instructions or control programs 60*b*. Some or all of such programs could be stored in programmable read-only memory such as flash memory 62. The control circuitry 60 can include executable instructions and associated hardware 64*a* for implementing an audio waveform generator. Additionally, where the device 28*i*' also includes a visual output, the control circuitry 60 can include executable instructions and/or output hardware 64*b*** to carry out a strobe control function.

The output from the audio waveform generator software and hardware **64*a* can be coupled to an audio drive circuit 66*a* which could include an optional amplifier as would be understood by those of skill in the art. The audio driver circuitry 66*a* can in turn drive an audio transducer such as a sounder or a loud speaker 66*b*. Alternately, or in addition thereto, the output device 28*i*' can incorporate strobe control circuitry 68*a* which is in turn coupled to a high intensity strobe light 68*b*** of a type which would be known to those of skill in the art.

Parameters, programs, messages and the like all without limitation, can be downloaded from the output control circuits 22' to and installed in the device **28*i*' via signaling loop circuit 26' and a duplex communications interface circuit 70. Circuit 70 is coupled to and in communication with the signaling loop circuit 26'**.

Duplex communication circuitry 70 has associated therewith a device address **70*a*. It will be understood that the device address 70*a* can be set in a variety of fashions and is unique to the respective device 28*i*'**.

The address can be set using mechanical switches, jumpers or the like at the device **28*i*'. Such settings can be effected in the field at the time the device is installed in the respective system 10'**. Alternately address settings can be established using read-only memories or programmable read-only memories, either at the time the respective device is manufactured or in the field with an appropriate programmer as would be understood by those of skill in the art.

Each of the devices of the plurality 28' would be installed in loop 26' with a unique address. The duplex communication interface circuitry 70 can in turn forward to control circuits 60, parameters, instructions, additions to or replacement control programs or software which are directed to the address of the device **28*i*'. Such information can be stored for subsequent use in flash memory 62. It will be understood that other types of programmable read-only memory come within the spirit and scope of the present invention. Further, the processor 60** can incorporate read-write memory as appropriate.

Representative parameters which can be downloaded to the device **28*i*' include, where the sounder 66*b* corresponds to a horn, output volume and/or tonal pattern, temporal or continuous. Where the sounder 66*b*** corresponds to chimes, the downloaded parameters can include output volume, repetition rate, and tonal characteristics.

Where the audible output device is a loud speaker which is intended to provide verbal type audio outputs, the downloaded parameters can include one or more predetermined messages. Such messages can be stored in the memory 62. All such stored messages can be extracted and presented to the speaker 66*b* via control circuit 60 in accordance with commands received from the output control circuitry 22'.

It will also be understood that the device 28*i'* could incorporate, optionally, audio specification switches 72*a* and/or output intensity switch(s) 72*b*. However, such switches are optional and could in fact be omitted.

Duplex communication circuitry 70 can be coupled to a power control switch 74 for purposes of coupling power from a local supply 50 to the device 28*i'* as needed. Alternatively, instead of a local supply, power can be delivered by circuit 26' to each of the devices on the loop. As those of skill will understand, the downloaded parameters and/or control programs stored in the memory 62 can specify all device settings as well as functionality needed to define how the respective output device 28*i'* is to carry out its predetermined function.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An output device for an alarm system comprising:

control circuitry, including a programmable element;

control software for the programmable element, the software receives and stores at least one of an audible output specifying indicium or an illumination output specifying indicium from a displaced source;

a non-volatile address specifying member; and input circuitry coupled to the control circuitry, and the non-volatile address specifying member, the input circuitry responsive to input signals which include address indicia and a representation of the audible specifying indicia, couples the indicia to the control software when the address indicia corresponds to the specified address.

2. An output device as in claim 1 which includes an audio transducer coupled to the control circuitry.

3. An output device as in claim 2 where the control circuitry and software electrically drive the audio transducer in accordance with the audible specifying indicia.

4. An output device as in claim 3 where the audio transducer comprises a verbal output transducer, and the indicia comprises a predetermined verbal output message.

5. An output device as in claim 4 which includes software which receives and stores visual output specifying indicia.

6. An output device as in claim 5 which includes a visual output transducer coupled to the control circuitry.

7. An output device as in claim 6 which includes a visual output transducer coupled to the control circuitry.

8. An output device as in claim 1 which includes software which receives and stores visual output specifying indicia.

9. An output device as in claim 8 which includes a visual output transducer coupled to the control circuitry.

10. An output device as in claim 9 where the visual output specifying indicia comprises an output light intensity specifying parameter.

11. An output device as in claim 1 where the address specifying member is manually settable.

* * * * *